US007699309B2

(12) United States Patent
Markgraf

(10) Patent No.: US 7,699,309 B2
(45) Date of Patent: Apr. 20, 2010

(54) COLLECTOR FOR STACKING SHEETS OF PAPER, PLASTICS, CARDBOARD AND THE LIKE

(75) Inventor: Wilhelm Markgraf, Tennenbronn (DE)

(73) Assignee: Mathias Bäuerle GmbH, St. Georgen (DE)

( * ) Notice: Subject to any disclaimer, the term of this patent is extended or adjusted under 35 U.S.C. 154(b) by 6 days.

(21) Appl. No.: 12/141,118

(22) Filed: Jun. 18, 2008

(65) Prior Publication Data

US 2008/0309005 A1 Dec. 18, 2008

(30) Foreign Application Priority Data

Jun. 18, 2007 (DE) ..... 10 2007 029 259

(51) Int. Cl.
*B65H 31/08* (2006.01)

(52) U.S. Cl. ..... 271/212; 271/209; 271/211; 271/213; 271/214; 270/32; 270/21.1; 270/52.14; 270/45; 270/46; 270/58.01; 270/59

(58) Field of Classification Search ..... 271/209, 271/211, 212, 213, 214; 270/32, 21.1, 52.14, 270/45, 46, 58.01, 59
See application file for complete search history.

(56) References Cited

U.S. PATENT DOCUMENTS

| | | | | |
|---|---|---|---|---|
| 3,396,966 | A * | 8/1968 | Solheim | 271/212 |
| 4,805,891 | A * | 2/1989 | Luperti et al. | 271/212 |
| 5,078,383 | A * | 1/1992 | Shiina et al. | 271/212 |
| 5,123,639 | A * | 6/1992 | Edwards | 271/212 |
| 5,147,092 | A * | 9/1992 | Driscoll et al. | 271/184 |
| 5,244,200 | A * | 9/1993 | Manzke | 271/198 |
| 5,253,861 | A * | 10/1993 | Schmaling | 271/213 |
| 5,451,038 | A * | 9/1995 | Hosking et al. | 271/3.01 |
| 5,655,761 | A * | 8/1997 | Sanchez | 271/4.09 |
| 5,775,689 | A * | 7/1998 | Moser et al. | 271/198 |
| 5,851,008 | A * | 12/1998 | Dilanchian et al. | 271/4.07 |
| 5,871,433 | A * | 2/1999 | Lehmann et al. | 493/420 |
| 5,908,188 | A * | 6/1999 | Katamoto et al. | 271/3.08 |
| 6,095,517 | A * | 8/2000 | Dinatale | 271/212 |
| 6,203,006 | B1 * | 3/2001 | Semanick et al. | 271/213 |
| 6,634,852 | B2 * | 10/2003 | Bakoledis | 414/789 |
| 6,805,346 | B2 * | 10/2004 | Stemmle | 271/178 |
| 2006/0017219 | A1 * | 1/2006 | Yamada | 271/209 |
| 2007/0210512 | A1 * | 9/2007 | Sakakibara et al. | 271/314 |

* cited by examiner

*Primary Examiner*—Patrick H Mackey
*Assistant Examiner*—Prasad V Gokhale
(74) *Attorney, Agent, or Firm*—Gudrun E. Huckett

(57) ABSTRACT

A collector for stacking sheets of paper, plastics, and cardboard has a feeding device and a tray downstream of the feeding device in the feeding direction. The tray is arranged in a lowered position relative to the feeding device. A stop is provided downstream of the tray. At least one transport roll transports sheets individually from the feeding device onto the tray to form a stack. An adjusting element is arranged in an area where the feeding device and the tray adjoin, wherein the adjusting element is adjustable between a lowered rest position and a position of use lifted relative to the rest position. In the position of use, the adjusting element lifts a trail end of a first sheet that has reached the tray such that a following second sheet is moved into a position underneath the trail end of the first sheet.

20 Claims, 2 Drawing Sheets

COLLECTOR FOR STACKING SHEETS OF PAPER, PLASTICS, CARDBOARD AND THE LIKE

BACKGROUND OF THE INVENTION

The invention relates to a collector for stacking sheets of paper, plastics, cardboard and the like, comprising a feeding device for the sheets, at least one tray for forming the stack, at least one stop for the sheets of the stack, and at least one transport roll with which the individual sheets are transported onto the tray or onto the stack portion already formed on the tray.

Sheets are compiled to stacks by means of such collectors. An example of sheets are bank account statements that have to be stacked in a certain sequence. The sheet with the address must be on top of the stack and facing up so that after the subsequent enveloping step the address is visible in the window of the envelope. Depending on the sequence in which the sheets of the stack are being fed, the sheets must be stacked top to bottom (feeding to the top of the stack) or bottom to top (feeding to the bottom of the stack).

SUMMARY OF THE INVENTION

It is an object of the present invention to design the collector of the aforementioned kind in such a way that the collector enables in a simple way stacking from top to bottom as well as stacking from bottom to top.

In accordance with the present invention, this is achieved in that the tray relative to the feeding device is arranged in a lowered position and in at least one adjusting element is arranged that in the area where the feeding device and the tray meet. The adjusting element is adjustable between a lowered rest position and a position of use. In the position of use, the adjusting element lifts the trail end of the sheet positioned in the area of the tray or the trail end of the stack already formed on the tray, viewed in the feeding direction, in such a way that the incoming sheet is moved under the lifted end of the preceding sheet or the already formed stack portion.

In the collector according to the present invention the sheets to be stacked are conveyed by means of the feeding device to the tray that is in lowered position on which tray the stacking is carried out. The first sheet that is fed forms the lowermost sheet of the stack. When the sheets are fed such that the last sheet must be positioned on top of the stack, the adjusting element is adjusted from the rest position into the position of use. Since the adjusting element is located at the transition from the feeding device to the tray that is lowered, the adjusting element provides an extension of the feeding device. This extension of the feeding device is used so that the fed sheets are stacked at the bottom of the stack. This is possible in that the trail end, in the feeding direction, of the sheet or of the stack portion already formed is lifted by the adjusting element so far that the following sheet can move underneath the lifted sheet end or stack end.

Advantageously, the collector is provided with a pocket with which the stack comprised of sheets can be folded. In this case, the sheets are transported so far in the tray that they rest against a stop of the pocket. In this way, all sheets within the stack are positioned precisely. As soon as the stack has been formed on the tray, the folding process is carried out by means of a folding device downstream of the pocket.

DESCRIPTION OF THE PREFERRED EMBODIMENTS

Figure 1:
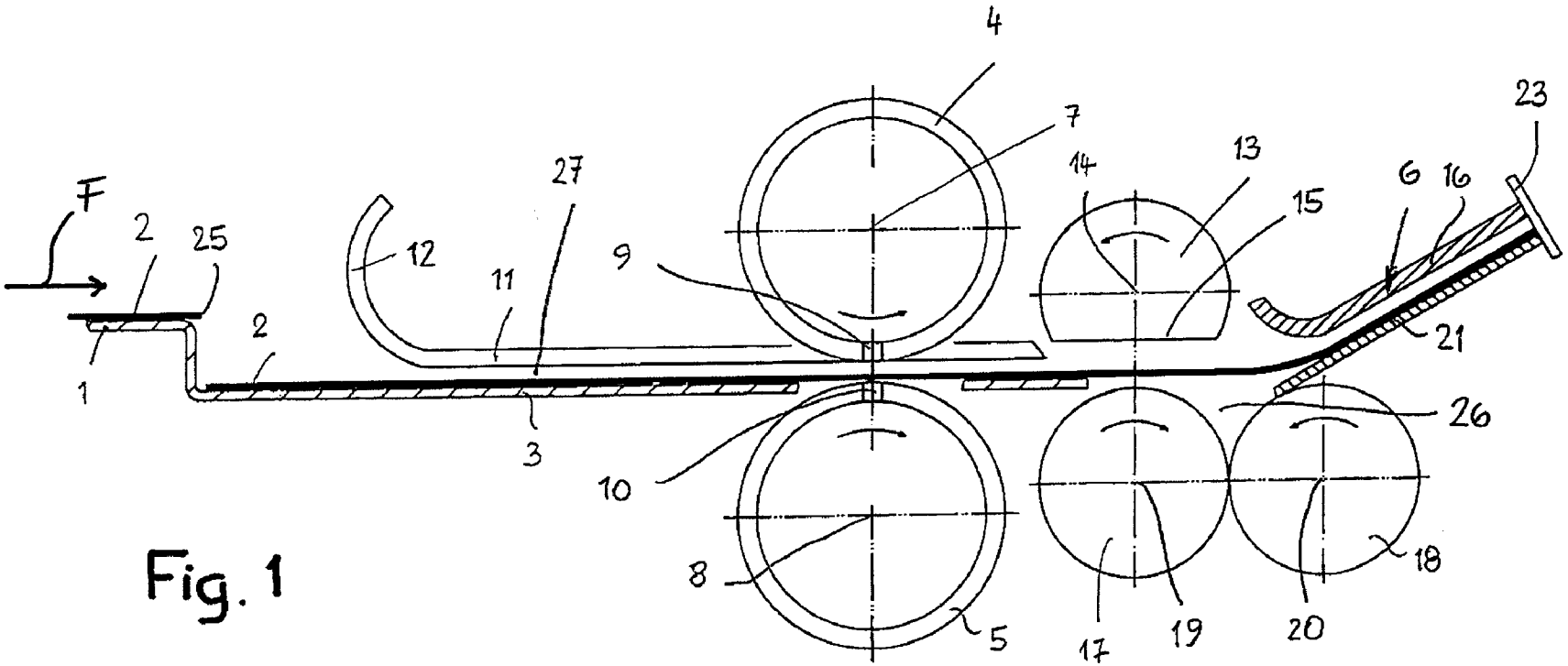
FIG. 1 shows in section and in a schematic illustration a collector according to the present invention in a first position for stacking sheets.

The collector is used for stacking sheets wherein the stacking sequence can be changed. The collector has a feeding device 1 on which the sheets 2 to be stacked are supplied as is known in the art. For transporting the sheets 2, the feeding device 1 is provided preferably with belts or bands or the like. The sheets 2 drop from the feeding device 1 onto a tray 3 on which they are transported by means of transport rolls 4, 5 in the direction toward a pocket 6.

The transport rolls 4, 5 are advantageously suction rolls that are rotatable in opposite directions to one another about parallel horizontal axes 7, 8. The suction rolls 4, 5 have suction openings 9, 10 in their outer walls by means of which the sheets 2 to be stacked in the tray 3 are transported by application of suction. The tray 3 has an opening in the area of the suction roll 5 so that the suction of the lower roll 5 can act on the sheets 2.

Opposite the tray 3 there is a guide element in the form of a guide plate 11 positioned at a spacing to the tray 3; the end 12 of the guide plate 11 that is facing the feeding device 1 is bent upwardly and is positioned at a spacing relative to the feeding device 1. The tray 3 and the guide plate 11 form a guide channel 27 for the sheets 2. The free end 12 of the guide plate 11 extends upwardly past the feeding device 1 in the feeding direction (arrow F) of the sheets 2. Since the free end 12 of the guide plate 11 is convexly curved opposite to the feeding device 1 (illustrated schematically with arrow F indicating the feeding direction of the sheets 2 on the feeding device 19, the sheets 2 when transported from the feeding device 1 onto the tray 3 are reliably guided underneath the guide plate 11 into the guide channel 27. The guide plate 11 has an opening in the area of the upper transport roll 4 so that the sheets 2 can be reliably engaged.

The two transport rolls 4, 5 have arranged downstream at least one upper transport roll 13 that it is rotatably driven about axis 14 positioned parallel to the axis 7. The wall of the transport rolls 13 is provided with a planar wall section 15. In the initial position illustrated in FIG. 1 the transport roll 13 is positioned such that this planar wall section 15 is parallel to the top side of the stack formed of the sheets 2 on the tray 3. The transport roll 13 is positioned in the area between the end of guide plate 11 and the pocket 6 whose upper boundary wall 16 is curved upwardly to widen the opening. In this way. it is ensured that the sheets 2 are fed reliably into the pocket 6.

In the area below the stack there are further oppositely rotatable rolls 17, 18 that contact one another and are rotatable relative to one another about parallel horizontal axes 19, 20. The axis of rotation 19 of roll 17 and the axis of rotation 14 of the transport roll 13 are positioned in a common vertical plane. The axis of rotation 20 of the roll 18 is positioned in the area below the pocket 6 whose lower wall 21 extends tangentially up to the circumferential wall of the roll 18.

Figure 2:
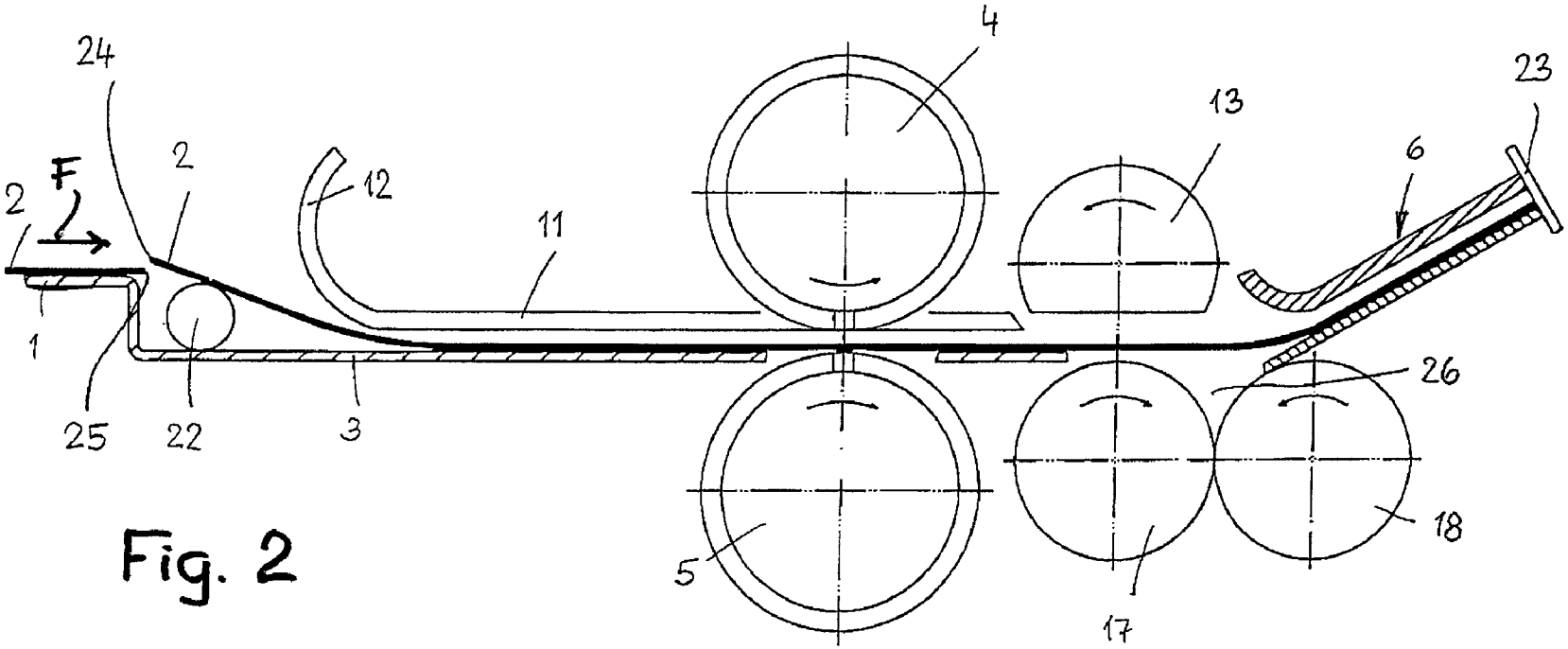
FIG. 2 shows the collector according to the invention in a second position for stacking the sheets.

As is shown in FIG. 2, in the area between the feeding device 1 and the free end 12 of the guide plate 11 there is at least one adjusting element 22 that can be moved from a lowered rest position into a position of use illustrated in FIG. 2 in the vertical direction. The adjusting element 22 can be a roller, a ball or the like. Several rollers, balls or the like are advantageously provided as adjusting elements 22 in a direction transversely to the plane of the drawing. They are supported in at least one carrier (not illustrated) that is either movable in the vertical direction or supported to be pivotable in the vertical direction. The adjusting element 22 is arranged such that the sheet 2 that is introduced into the pocket 6 and rests with its lead edge against a stop 23 of the pocket 6 when viewed in the feeding direction (arrow F), rests with its trail end on the adjusting element 22. The element 22 has such a height that the trail edge 24 of the sheet 2 inserted in the pocket 6 is positioned in the area above the feeding plane of the next sheet 2. This has the result that the sheet 2 that is still positioned according to FIG. 2 on the feeding device 1 with its lead end 25 reaches a position underneath the trail end of the sheet 2 positioned in the pocket 6. In this way, the sheets arriving on the feeding device 1 are sequentially pushed under the stack portion that is positioned on the tray 3.

When the adjusting element 22 in the rest position is moved downwardly (FIG. 1) the following sheets 2 will be placed onto the sheets 2 already located on the tray 3. In this way, for example, a sorting sequence A to Z is possible. When sorting within the stack is to be done from Z to A, the adjusting element 22 is lifted into the position of use according to FIG. 2. In this way, the following sheets 22 are always transported into a position at the bottom of the stack of sheets 2 positioned on the tray 3 so that the sheet 2 supplied last is positioned at the bottom of the stack on the tray 3. In the adjustment of the collector according to FIG. 1 the last supplied sheet 2 is therefore positioned on the top side of the stack collected on the tray 3.

The sheets 2 after having been individualized in an upstream feeder (not illustrated) are supplied by means of the feeding device 1. The feeding device 1 conveys the sheets 2 until they reach the area of the transport rolls 4, 5. At this point, transportation of the sheets 2 is taken over by these transport rolls. When the adjusting element 22 is in the lowered rest position (FIG. 1), then the upper transport rolls 4 take over transportation of the sheets 2 into the pocket 6. The sheets 2 are supplied at a short spacing relative to one another sequentially and are stacked on the tray 3. The sheets 2 supplied at a short spacing one after the other are transported onto the tray 3 so far by means of the upper transport roll 4 until the lead edge 25 comes to rest against the stop 23 of the pocket 6. The transport roll 13 is in the initial position illustrated in FIG. 1 in which the planar wall section 15 is parallel to the top side of the stack formed on the tray 3. As soon as the stack has been completed on the tray 3, transport roll 13 is rotatably driven counterclockwise. This has the results that the stack is further loaded in the direction toward the pocket 6. Since the sheets 2 of the stack are however resting against the stop 23, the stack bulges downwardly in the area between the pocket 6 and the transport roll 13 in a V-shape. This bulging section reaches the gap 26 between the oppositely driven transport rolls 17 and 18. The rolls 17, 18 are driven such that the bulging V-shaped section of the stack is engaged by them and is pulled downwardly between the rolls 17, 18. In this way, the stack is folded.

When the sheets 2 are fed to the tray with the adjusting element 22 in the lowered rest position, the lower transport roll 5 is not driven.

When the stacking sequence A to Z is to be changed to the sequence Z to A, the adjusting element 22 is lifted from the rest position into the position of use according to FIG. 2 so that the individual sheets are not stacked at the top of the stack (top to bottom) but at the bottom of the stack (bottom to top). In this case, the lower transport roll 5 takes over transportation of the lowermost sheet 2. The upper transport roll 4 in this case can be standing still. The sheets 2 are also conveyed so far into the pocket 6 until their lead edge 25 rests against the stop 23 in the pocket 6. As soon as the stack has been formed on the tray 3, the transport roll 13 is driven in rotation in counterclockwise direction so that the stack in the area between the transport roll 13 and the pocket 6 bulges downwardly in a V-shape and is engaged by the oppositely driven rolls 17 and 18. These two rolls 17, 18 are driven such that the bulging V-shaped portion of the stack is pulled downwardly in the nip 26 of the rolls 17, 18 so that the stack is folded when passing between the two rolls 17, 18.

The adjusting element 22 is advantageously freely rotatable so that the sheets 2 are properly stacked from bottom to top on the tray 3.

In order for sheets having different lengths to be folded in the described way by stacking from bottom to top or top to bottom, it is advantageous when the spacing between the adjusting element 22 and the pocket 6 is adjustable.

The adjusting element 22 forms an extension of the feeding device 1 by means of which the trail end of the sheet 2 in the feeding direction (arrow F) can be lifted in the area of the tray 3 to such an extent that the following sheet 2 coming from the feeding device 1 can be moved underneath the lifted end of the sheet 2 positioned on the tray 3. In connection with the transport rolls 4, 5 a very simple switching between stacking from top to bottom and stacking from bottom to top is possible. When the sheets 2 are stacked on the tray 3 from the top, the uppermost sheet 2 of a stack is transported by means of the upper transport roll 4, respectively. When stacking from bottom to top the lowermost sheet 2 is engaged by the transport roll 5, respectively, and transported to the pocket 6. Since the transport rolls 4, 5 are advantageously suction rolls, the uppermost or lowermost sheet 2 can be reliably transported, respectively, without the sheets that are already stacked within the stack also being transported. In this way it is ensured the sheets 2 in the stack are reliably and uniformly stacked on one another.

The specification incorporates by reference the entire disclosure of German priority document 10 2007 029 259.9 having a filing date of Jun. 18, 2007.

While specific embodiments of the invention have been shown and described in detail to illustrate the inventive principles, it will be understood that the invention may be embodied otherwise without departing from such principles.

What is claimed is:

1. A collector for stacking sheets of paper, plastics, and cardboard, the collector comprising:

a feeding device;

at least one tray downstream of the feeding device in a feeding direction of the feeding device, wherein the at least one tray is arranged in a lowered position relative to the feeding device;

at least one stop downstream of the at least one tray in the feeding direction;

at least one transport roll transporting sheets individually from the feeding device onto the at least one tray to form a stack;

at least one adjusting element arranged in an area where the feeding device and the at least one tray adjoin, wherein the at least one adjusting element is adjustable between a lowered rest position and a position of use lifted relative to the rest position;

wherein, in the position of use, the at least one adjusting element lifts a trail end of a first sheet that has reached the at least one tray such that a following second sheet is moved into a position underneath the trail end of the first sheet;

at least one guide element positioned opposite the at least one tray at a spacing from the at least one tray, wherein the at least one adjusting element is arranged between the feeding device and the at least one guide element;

wherein the at least one guide element and the at least one tray together define a guide channel; and wherein the at least one guide element has an opening so that the at least one transport roll penetrates into the guide channel.

2. The collector according to claim 1, wherein, when the at least one adjusting element is in the lowered rest position, the sheets are stacked in a first stacking sequence and wherein, when the at least one adjusting element is in the position of use, the sheets are stacked in a second stacking sequence that is reverse to the first stacking sequence.

3. A collector for stacking sheets of paper, plastics, and cardboard, the collector comprising:

a feeding device;

at least one tray downstream of the feeding device in a feeding direction of the feeding device, wherein the at least one tray is arranged in a lowered position relative to the feeding device;

at least one stop downstream of the at least one tray in the feeding direction;

at least one transport roll transporting sheets individually from the feeding device onto the at least one tray to form a stack;

at least one adjusting element arranged in an area where the feeding device and the at least one tray adjoin, wherein the at least one adjusting element is adjustable between a lowered rest position and a position of use lifted relative to the rest position;

wherein, in the position of use, the at least one adjusting element lifts a trail end of a first sheet that has reached the at least one tray such that a following second sheet is moved into a position underneath the trail end of the first sheet;

at least one guide element positioned opposite the at least one tray at a spacing from the at least one tray, wherein the at least one adjusting element is arranged between the feeding device and the at least one guide element;

wherein the at least one guide element has an end facing the feeding device and the end facing the feeding device is curved upwardly in a direction counter to the feeding direction.

4. The collector according to claim 3, wherein, when the at least one adjusting element is in the lowered rest position, the sheets are stacked in a first stacking sequence and wherein, when the at least one adjusting element is in the position of use, the sheets are stacked in a second stacking sequence that is reverse to the first stacking sequence.

5. The collector according to claim 3, wherein the at least one guide element and the at least one tray together define a guide channel.

6. A collector for stacking sheets of paper, plastics, and cardboard, the collector comprising:

a feeding device;

at least one tray downstream of the feeding device in a feeding direction of the feeding device, wherein the at least one tray is arranged in a lowered position relative to the feeding device;

at least one stop downstream of the at least one tray in the feeding direction;

at least one transport roll transporting sheets individually from the feeding device onto the at least one tray to form a stack;

at least one adjusting element arranged in an area where the feeding device and the at least one tray adjoin, wherein the at least one adjusting element is adjustable between a lowered rest position and a position of use lifted relative to the rest position;

wherein, in the position of use, the at least one adjusting element lifts a trail end of a first sheet that has reached the at least one tray such that a following second sheet is moved into a position underneath the trail end of the first sheet;

wherein the at least one transport roll is a suction roll.

7. The collector according to claim 6, wherein, when the at least one adjusting element is in the lowered rest position, the sheets are stacked in a first stacking sequence and wherein, when the at least one adjusting element is in the position of use, the sheets are stacked in a second stacking sequence that is reverse to the first stacking sequence.

8. The collector according to claim 6, further comprising at least one guide element positioned opposite the at least one tray at a spacing from the at least one tray, wherein the at least one adjusting element is arranged between the feeding device and the at least one guide element.

9. The collector according to claim 8, wherein the at least one guide element and the at least one tray together define a guide channel.

10. A collector for stacking sheets of paper, plastics, and cardboard, the collector comprising:

a feeding device;

at least one tray downstream of the feeding device in a feeding direction of the feeding device, wherein the at least one tray is arranged in a lowered position relative to the feeding device;

at least one stop downstream of the at least one tray in the feeding direction;

at least one transport roll transporting sheets individually from the feeding device onto the at least one tray to form a stack;

at least one adjusting element arranged in an area where the feeding device and the at least one tray adjoin, wherein the at least one adjusting element is adjustable between a lowered rest position and a position of use lifted relative to the rest position;

wherein, in the position of use, the at least one adjusting element lifts a trail end of a first sheet that has reached the at least one tray such that a following second sheet is moved into a position underneath the trail end of the first sheet;

at least one pocket arranged downstream of the at least one transport roll in the feeding direction.

11. The collector according to claim 10, further comprising at least one folding device arranged downstream of the at least one pocket in that sheets after having been collected in the at least one pocket are guided into the at least one folding device and folded.

12. The collector according to claim 11, wherein the at least folding device comprises at least two oppositely driven rolls that contact one another.

13. The collector according to claim 10, wherein the at least one adjusting element is freely rotatable.

14. The collector according to claim 10, wherein the at least one adjusting element is a roll and has an axis that is parallel to a plane of the at least one tray.

15. The collector according to claim 10, wherein the at least one adjusting element is a ball.

16. The collector according to claim 10, further comprising at least one guide element positioned opposite the at least one tray at a spacing from the at least one tray, wherein the at least one adjusting element is arranged between the feeding device and the at least one guide element.

17. The collector according to claim 16, wherein the at least one guide element and the at least one tray together define a guide channel.

18. The collector according to claim 17, wherein the at least one guide element has an opening so that the at least one transport roll penetrates into the guide channel.

19. The collector according to claim 17, wherein the at least one tray has an opening so that the at least one transport roll can penetrate into the guide channel.

20. The collector according to claim 10, wherein, when the at least one adjusting element is in the lowered rest position, the sheets are stacked in a first stacking sequence and wherein, when the at least one adjusting element is in the position of use, the sheets are stacked in a second stacking sequence that is reverse to the first stacking sequence.

* * * * *